US010234202B2

(12) United States Patent
Hwang et al.

(10) Patent No.: US 10,234,202 B2
(45) Date of Patent: Mar. 19, 2019

(54) CONDENSATE WATER CONTROLLING TYPE DRYER

(71) Applicants: POSTECH ACADEMY-INDUSTRY FOUNDATION, Pohang (KR); ADVANCED MANUFACTURE TECHNOLOGY CENTER, CHINA ACADEMY OF MACHINERY SCIENCE & TECHNOLOGY, Beijing (CN)

(72) Inventors: Woon Bong Hwang, Pohang (KR); Zhongde Shan, Beijing (CN); Shuangfeng Wu, Beijing (CN); Byung Rak Park, Busan (KR); Won Shik Kwak, Icheon (KR)

(73) Assignees: POSTECH ACADEMY-INDUSTRY FOUNDATION, Pohang-si (KR); ADVANCED MANUFACTURE TECHNOLOGY CENTER, CHINA ACADEMY OF MACHINERY SCIENCE & TECHNOLOGY, Beijing (CN)

( * ) Notice: Subject to any disclaimer, the term of this patent is extended or adjusted under 35 U.S.C. 154(b) by 238 days.

(21) Appl. No.: 15/323,484

(22) PCT Filed: Jul. 7, 2015

(86) PCT No.: PCT/KR2015/007025
§ 371 (c)(1),
(2) Date: Jan. 3, 2017

(87) PCT Pub. No.: WO2016/006919
PCT Pub. Date: Jan. 14, 2016

(65) Prior Publication Data
US 2017/0146294 A1 May 25, 2017

(30) Foreign Application Priority Data
Jul. 7, 2014 (KR) ..... 10-2014-0084780

(51) Int. Cl.
*F26B 25/12* (2006.01)
*F26B 7/00* (2006.01)
*F26B 9/06* (2006.01)

(52) U.S. Cl.
CPC ..... *F26B 25/12* (2013.01); *F26B 7/00* (2013.01); *F26B 9/06* (2013.01)

(58) Field of Classification Search
CPC ..... F26B 25/12; F26B 7/00; F26B 9/06
(Continued)

(56) References Cited

U.S. PATENT DOCUMENTS 4,182,411 A * 1/1980 Sumitomo ..... F28B 1/02 165/110
4,313,494 A * 2/1982 Bengtsson ..... F28D 1/0316 165/148
(Continued)

FOREIGN PATENT DOCUMENTS

JP 2006-296460 11/2006
KR 10-2002-0024692 4/2002
(Continued)

*Primary Examiner* — Stephen M Gravini
(74) *Attorney, Agent, or Firm* — Lex IP Meister, PLLC

(57) ABSTRACT

Disclosed is a condensate water control dryer. The condensate water control dryer includes: a dryer main body which has a drying space formed therein; a first condensate water panel which is attached, in a first direction, to an inner wall surface of the drying space of the dryer main body and has a superhydrophilic surface; a second condensate water panel which is attached, in a second direction that intersects the first direction, to the inner wall surface of the drying space of the dryer main body and has a superhydrophobic surface; and attachment members which attach the first condensate
(Continued)

water panel and the second condensate water panel to the inner wall surface of the dryer main body.

12 Claims, 10 Drawing Sheets

(58) Field of Classification Search
USPC ..... 34/201
See application file for complete search history.

(56) References Cited

U.S. PATENT DOCUMENTS 4,621,685 A * 11/1986 Nozawa ..... F24F 13/22 165/111
4,662,990 A * 5/1987 Bonanno ..... B01D 1/26 159/20.1
4,702,798 A * 10/1987 Bonanno ..... B01D 1/26 159/17.1
4,893,669 A * 1/1990 Kashiwada ..... F28C 1/04 165/103
5,105,556 A * 4/1992 Kurokawa ..... F26B 3/00 134/11
6,769,196 B2 * 8/2004 Park ..... D06F 58/24 165/179
7,966,746 B2 * 6/2011 Py ..... F26B 5/06 34/413
8,365,539 B2 * 2/2013 Chen ..... D06F 58/206 62/3.2
8,732,978 B2 * 5/2014 Kuan ..... F26B 5/005 239/303
8,904,668 B2 * 12/2014 Priebe ..... F26B 3/22 101/450.1
8,973,286 B1 * 3/2015 Hyde ..... D06F 58/206 34/595
9,395,125 B2 * 7/2016 Fox ..... F28F 27/00
9,573,165 B2 * 2/2017 Weber ..... B05D 5/04
2017/0146294 A1 * 5/2017 Hwang ..... F26B 7/00

FOREIGN PATENT DOCUMENTS

KR 10-0664284 1/2007
KR 10-2008-0018746 2/2008
KR 10-1140218 5/2012
WO WO 2012125930 A1 * 9/2012 ..... B01D 1/0035
WO 2014/012223 1/2014
WO WO 2016006919 A1 * 1/2016 ..... F26B 7/00

* cited by examiner

CONDENSATE WATER CONTROLLING TYPE DRYER

BACKGROUND OF THE INVENTION (a) Field of the Invention

The present invention relates to a condensate water control dryer which has therein both a superhydrophilic surface and a superhydrophobic surface so as to allow condensate water to flow smoothly, thereby improving drying performance.

(b) Description of the Related Art

In general, dryers are used for various purposes in typical homes and industrial sites in order to reduce moisture contained in various materials such as clothes, foods, chemicals, and raw materials.

The dryers are classified into dryers using hot air, and dryers using infrared rays or high frequency waves. The dryers using hot air and the dryers using infrared rays or high frequency waves have common features in that moisture is evaporated from a surface and the moisture is diffused into the outside atmosphere.

Drying performance of a dryer depends on a difference of partial pressure of moisture vapor inside and outside of a material, and when drying is performed in the dryer at a predetermined or higher level, partial pressure of outside moisture vapor is saturated, and condensate water is produced in the dryer.

Recently, based on the shape, the dryer is classified into a box type dryer which is used for a small capacity such as clothes and dishes and dries the items in a box, a tunnel type dryer which is used for a large capacity such as fruits and vegetables and has a tunnel structure that may continuously dry the items, and a kiln dryer which is used for chemicals and dries the items in a horizontal cylinder while rotating the items.

In the case of the dryer which is not opened to the outside, there is a problem in that the produced condensate water is present in the dryer, such that there is likelihood that the condensate water will be introduced back into an object to be dried.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a condensate water control dryer capable of inducing a flow of condensate water produced in the dryer, thereby preventing the condensate water from being introduced back into an object to be dried in the dryer, and improving drying performance.

An exemplary embodiment of the present invention provides a condensate water control dryer including: a dryer main body which has a drying space formed therein; a first condensate water panel which is attached, in a first direction, to an inner wall surface of the drying space of the dryer main body and has a superhydrophilic surface; a second condensate water panel which is attached, in a second direction that intersects the first direction, to the inner wall surface of the drying space of the dryer main body and has a superhydrophobic surface; and attachment members which attach the first condensate water panel and the second condensate water panel to the inner wall surface of the dryer main body.

The dryer main body may include: a bottom plate which is supported on a floor; a pair of lateral plates which is assembled to the bottom plate and defines sidewalls; a roof plate which is assembled to the lateral plate; and a door plate which is rotatably installed on the lateral plate and seals the drying space.

The first condensate water panel may be attached to the lateral plate in the drying space, and the second condensate water panel may be attached to the roof plate in the drying space.

The first condensate water panel may be attached to the roof plate in the drying space, and the second condensate water panel may be attached to the lateral plate in the drying space.

Guide slits, which guide a flow of the condensate water produced in the drying space, may be formed in surfaces of the first condensate water panel and the second condensate water panel.

The guide slits may include: first slits which are formed in the first condensate water panel; and second slits which are formed in the second condensate water panel in a direction that intersects a direction in which the first slits are formed.

The guide slits may be formed as a plurality of recessed grooves which is recessed inward from the surfaces of the first condensate water panel and the second condensate water panel.

The dryer main body, the first condensate water panel, and the second condensate water panel may be made of an electro-conductive steel material. The attachment member may be a magnetic member having magnetic force.

According to the exemplary embodiment of the present invention, the moisture evaporated in the dryer is condensed on the first condensate water panel having the superhydrophilic surface, and the condensate water is smoothly moved, by its own weight, to the second condensate water panel having the superhydrophobic surface, thereby preventing the condensate water from being introduced back into an object to be dried.

In addition, the processes in which the condensate water is produced and flows in the dryer are carried out without using external energy, and the condensate water may flow by its own weight, thereby improving drying performance of the dryer.

DETAILED DESCRIPTION OF THE EMBODIMENTS

Figure 1:
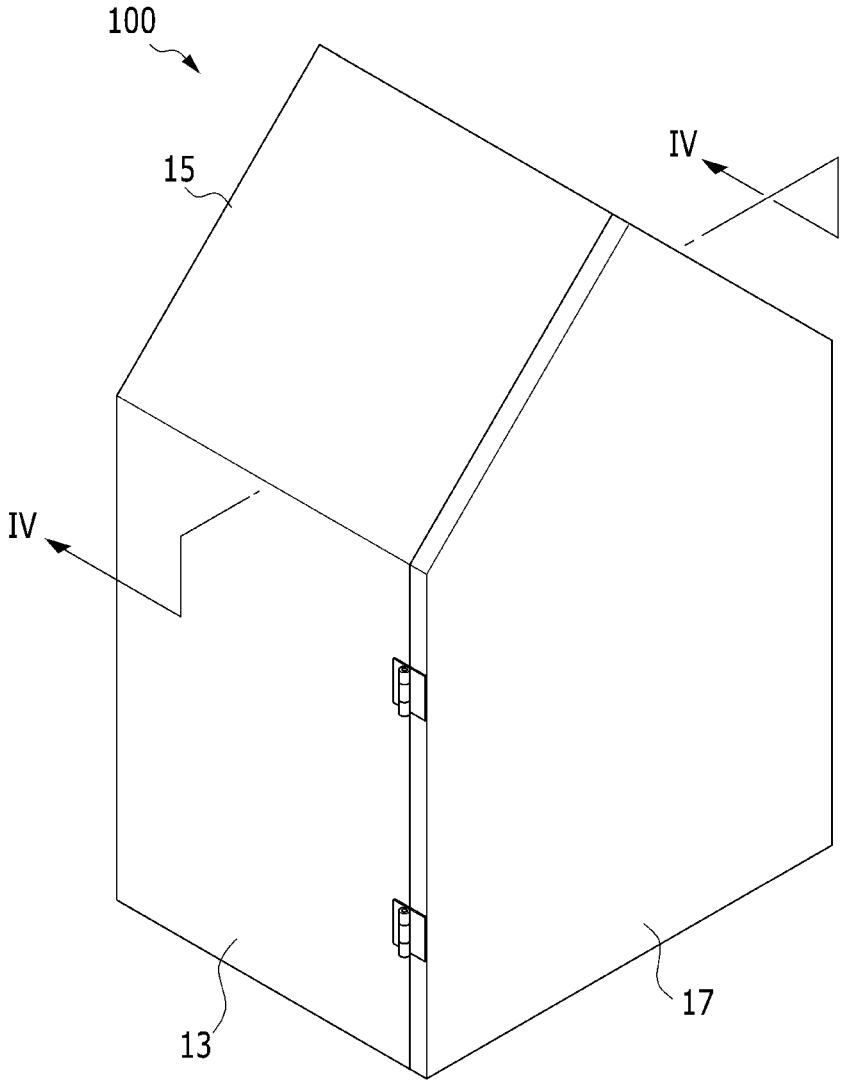
FIG. 1 is a perspective view schematically illustrating a condensate water control dryer according to a first exemplary embodiment of the present invention.

Hereinafter, an exemplary embodiment of the present invention will be described in detail with reference to the accompanying drawings so that those skilled in the technical field to which the present invention pertains may easily carry out the exemplary embodiment. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
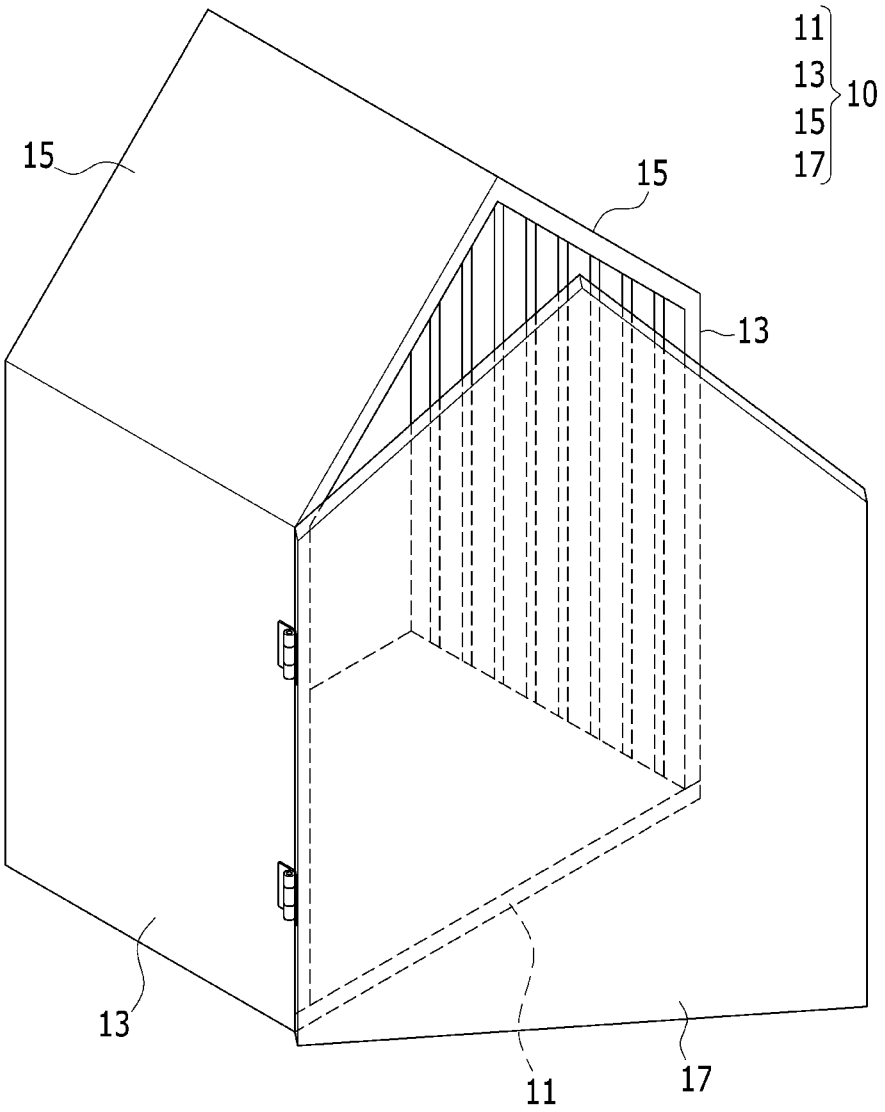
FIG. 2 is a perspective view schematically illustrating a state in which a door plate of the condensate water control dryer in FIG. 1 is partially opened.
Figure 3:
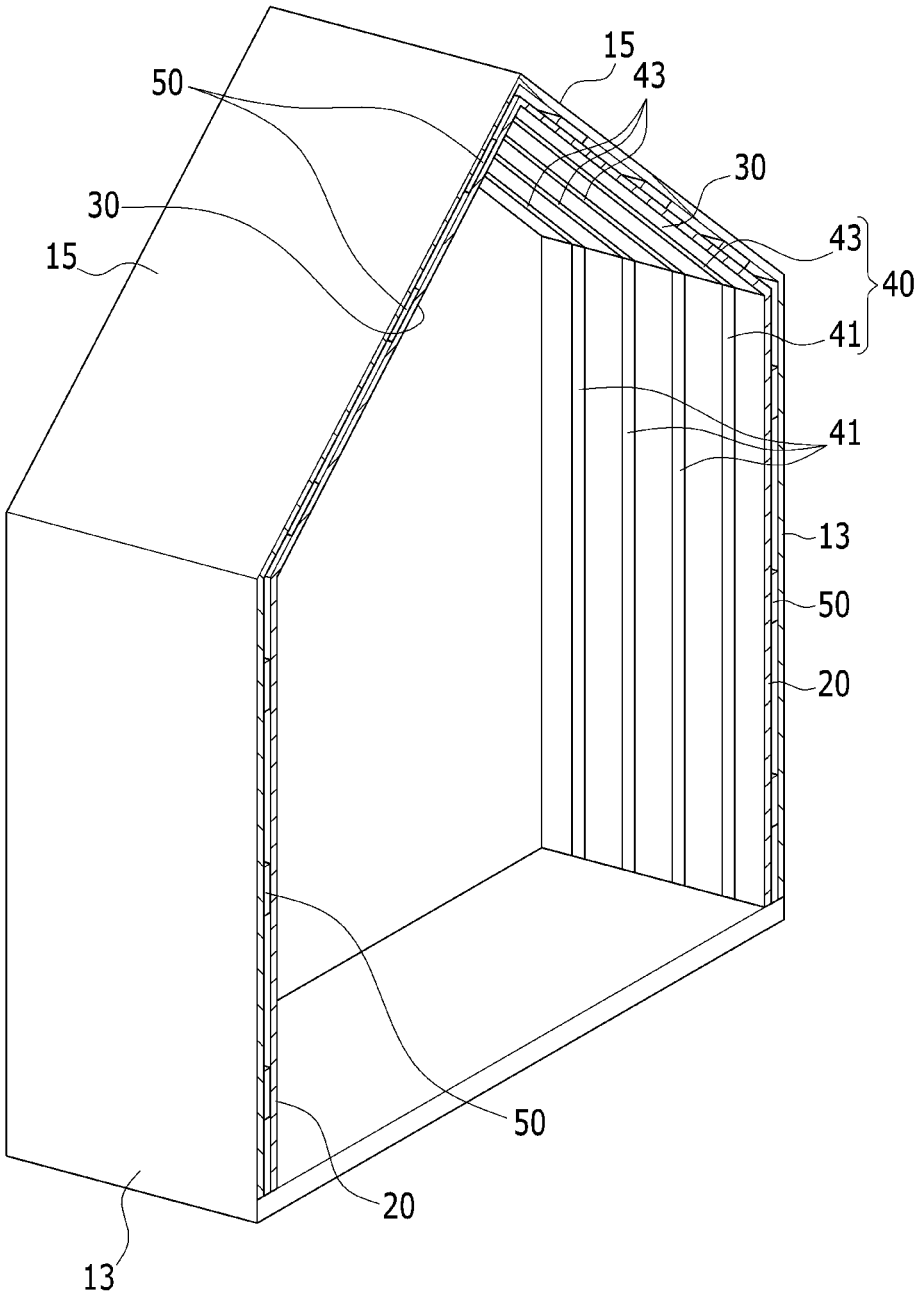
FIG. 3 is a bottom perspective view schematically illustrating a state in which a storage space is opened by removing the door plate of the condensate water control dryer in FIG. 1.
Figure 4:
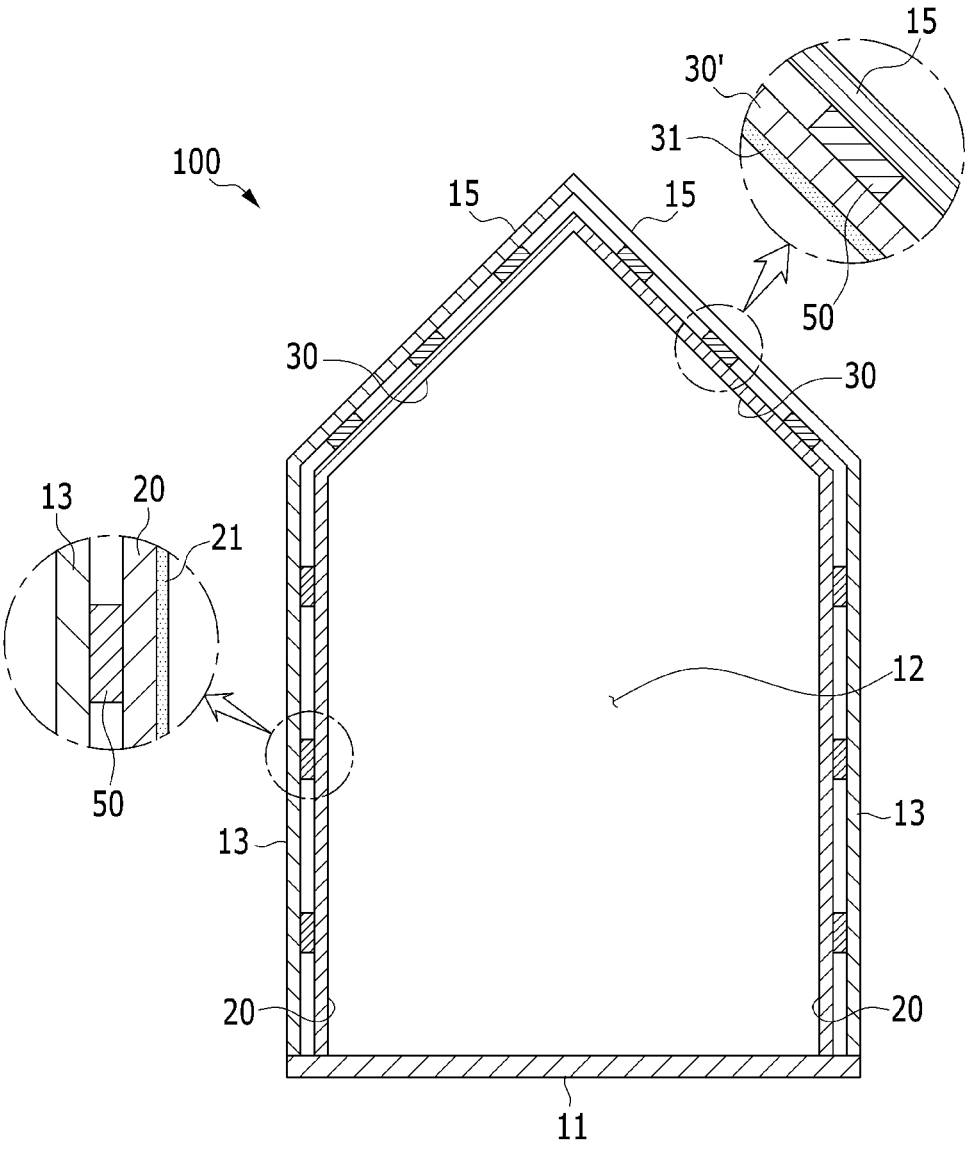
FIG. 4 is a cross-sectional view taken along line IV-IV in FIG. 1.

FIG. 1 is a perspective view schematically illustrating a condensate water control dryer according to a first exemplary embodiment of the present invention, FIG. 2 is a perspective view schematically illustrating a state in which a door plate of the condensate water control dryer in FIG. 1 is partially opened, FIG. 3 is a bottom perspective view schematically illustrating a state in which a storage space is opened by removing the door plate of the condensate water control dryer in FIG. 1, and FIG. 4 is a cross-sectional view taken along line IV-IV in FIG. 1.

As illustrated in FIGS. 1 to 4, a condensate water control dryer 100 according to the exemplary embodiment of the present invention includes a dryer main body 10 which has a drying space formed therein, a first condensate water panel 20 which is attached, in a first direction, to an inner wall surface of the drying space of the dryer main body 10 and has a superhydrophilic surface, a second condensate water panel 30 which is attached, in a second direction that intersects the first direction, to the inner wall surface of the drying space of the dryer main body 10 and has a superhydrophobic surface, and attachment members 50 which attach the first condensate water panel 20 and the second condensate water panel 30 to the inner wall surface of the dryer main body 10.

The dryer main body 10 has therein a drying space 12 in which various objects to be dried, such as clothes, foods, chemicals, and raw materials, are stored and dried.

The dryer main body 10 includes a bottom plate 11 which is supported on a floor, a pair of lateral plates 13 which is assembled to the bottom plate 11 and defines sidewalls, roof plates 15 which are assembled to the lateral plates 13, and a door plate 17 which is rotatably installed on the lateral plate 13 and seals the drying space 12.

The bottom plate 11 is supported on the floor on which the dryer is installed. The lateral plates 13 are assembled to the bottom plate 11.

The lateral plates 13 define the sidewalls of the dryer, and may be assembled to an edge of the bottom plate 11. The lateral plates 13 and the bottom plate 11 may be assembled by being fitted with each other, or may be assembled by using separate fastening means such as bolts. A pair of lateral plates 13 may be assembled to both sides of the edge of the bottom plate 11. The roof plates 15 may be assembled to upper sides of the lateral plates 13.

The roof plates 15 are assembled to the upper sides of the lateral plates 13, thereby defining a roof portion in a state in which the dryer is installed. The roof plates 15 may be formed to be inclined at the upper sides of the lateral plates 13.

As described above, the drying space 12 may be formed in the dryer main body 10 by assembling the bottom plate 11, the lateral plates 13, and the roof plates 15. Meanwhile, the door plate 17, which selectively opens the drying space 12, is installed on the lateral plate 13.

The door plate 17 is rotatably installed on any one of the lateral plates 13, and may selectively open and close the drying space 12. The door plate 17 is installed on the lateral plate 13 by means of a hinge or the like, and may selectively open or close the drying space 12.

The first condensate water panel 20 and the second condensate water panel 30, which facilitate the production of the condensate water and control a flow of the produced condensate water, are installed in the dryer main body 10.

Figure 5:
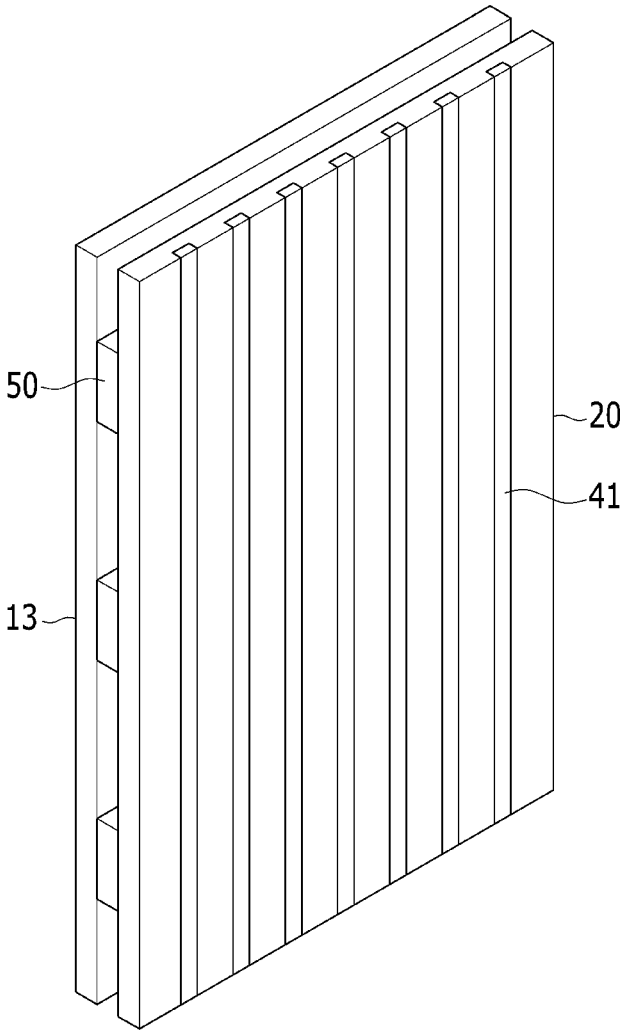
FIG. 5 is a main part perspective view schematically illustrating a state in which a first condensate water panel installed in the condensate water control dryer in FIG. 1 is installed on an inner wall surface of the dryer.
Figure 6:
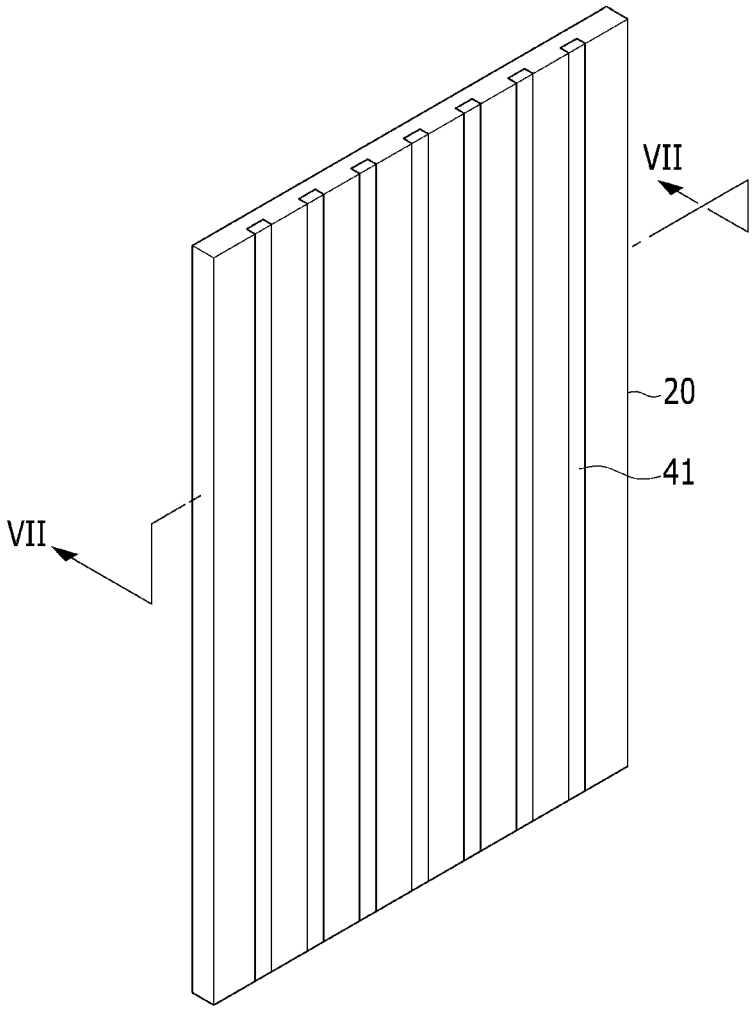
FIG. 6 is a perspective view schematically illustrating a state in which guide slits having a polygonal groove shape are formed in the first condensate water panel in FIG. 5.

FIG. 5 is a main part perspective view schematically illustrating a state in which the first condensate water panel installed in the condensate water control dryer in FIG. 1 is installed on the inner wall surface of the dryer, and FIG. 6 is a perspective view schematically illustrating a state in which guide slits having a polygonal groove shape are formed in the first condensate water panel in FIG. 5.

As illustrated in FIGS. 5 and 6, the first condensate water panels 20 are attached, in the first direction, to the lateral plates 13 in the drying space 12. Here, the first direction is exemplarily described as a height direction in which the lateral plate 13 is installed. The first condensate water panel 20 may be detachably installed on a surface of the lateral plate 13 by the attachment members 50.

More specifically, in the present exemplary embodiment, a magnetic member may be applied as the attachment member 50. That is, the first condensate water panel 20 and the lateral plate 13 may be made of a steel material for the purpose of durability, and the attachment members 50 are installed between the first condensate water panel 20 and the lateral plate 13, such that the first condensate water panel 20 may be selectively attached to the lateral plate 13. The magnetic member is exemplarily described as being applied as the attachment member 50, but the present invention is not necessarily limited thereto, and the first condensate water panel 20 may be detachably attached to the lateral plate 13 in a state in which an adhesive is applied on a plate shaped substrate.

A superhydrophilic surface may be formed on a surface of the first condensate water panel 20. The superhydrophilic surface may be formed on the surface of the first condensate water panel 20 by forming a micrometer-scale minute unevenness by allowing the surface of the first condensate water panel 20 to be subjected to a physical or chemical treatment. To form the superhydrophilic surface, both a micrometer-scale minute unevenness and a nanoscale minute unevenness may be included. As an example, in the case of the micrometer-scale minute unevenness, a height or depth of the unevenness formed on the surface may be 1 μm or more and less than 1,000 μm, and in the case of the nanoscale minute unevenness, a height or depth of the unevenness formed on the surface may be 1 nm or more and less than 1,000 nm.

Therefore, the surface of the first condensate water panel 20 may be formed as a superhydrophilic surface having a contact angle of less than 10 degrees. As described above, the reason why the superhydrophilic surface is formed on the first condensate water panel 20 is to allow the condensate water to be produced on lateral surfaces of the dryer main body 10 in the drying space 12 in the dryer main body 10.

The second condensate water panel 30 may be attached, in the second direction that intersects the first direction, to the roof plate 15 in the drying space 12. Here, the second direction is a direction that intersects the first direction, and is exemplarily described as a lateral direction of the roof plate 15. The second condensate water panel 30 may be detachably installed on the surface of the roof plate 15 by the attachment members 50. The attachment member 50 for attaching the second condensate water panel 30 to the roof plate 15 may be the same magnetic member as the attachment member 50 for attaching the first condensate water panel 20. In a case in which the second condensate water panel 30 is attached to the roof plate 15 by using the attachment member 50, the roof plate 15 and the second condensate water panel 30 may be made of an electro-conductive steel material.

A surface of the second condensate water panel 30 may be formed as a superhydrophobic surface. In the present exemplary embodiment, the surface of the second condensate water panel 30 may be formed as the superhydrophobic surface by coating the surface of the second condensate water panel 30 with a hydrophobic coating agent (not illustrated).

The hydrophobic coating agent may be formed as a hydrophobic polymeric layer including at least one hydrophobic material selected from a fluoride resin, fluorine-based silane coupling agents, a fluorine-based isocyanate compound, alkanethiol, an organic silane compound, fatty acid, an aromatic azide compound, a mixture thereof, and a polymer thereof.

The reason why the surface of the second condensate water panel 30 is formed as the superhydrophobic surface as described above is to allow the condensate water to be concentratedly produced on the surface of the first condensate water panel 20, thereby enabling the condensate water to be smoothly produced, and enabling the produced condensate water to flow smoothly. Therefore, the contact angle of the surface of the second condensate water panel 30 is at least greater than the contact angle of the surface of the first condensate water panel 20, and as an example, the contact angle of the surface of the second condensate water panel 30 may be 120 degrees or greater, or 160 degrees or greater.

Guide slots 40, which more smoothly induce the capture and the flow of the condensate water produced in the drying space 12, may be formed in the first condensate water panel 20 and the second condensate water panel 30. The guide slots 40 may include first slits 41 formed in the first condensate water panel 20, and second slits 43 formed in the second condensate water panel 30.

The plurality of first slits 41 may be formed to have a long length in a height direction of the first condensate water panel 20. The first slit 41 serves to guide a flow of the condensate water produced on the surface of the first condensate water panel 20, and may be formed as a recessed groove recessed inward from the surface of the first condensate water panel 20. Therefore, the condensate water produced on the surface of the first condensate water panel 20 may be moved by its own weight through the first slit 41. The second slit 43 may be formed in the surface of the second condensate water panel 30 while having a recessed groove shape recessed inward from the surface of the second condensate water panel 30. The second slit 43 may be formed to have a long length in a direction (i.e., a lateral direction of the second condensate water panel 30) that intersects the direction in which the first slit 41 is formed. At least two or more second slits 43 may be formed in the second condensate water panel 30. The reason why the second slit 43 is formed in the second condensate water panel 30 as described above is to guide the movement of the condensate water when the condensate water is moved as the dryer main body 10 is inclined.

As described above, the first slit 41 and the second slit 43 may have a recessed groove shape formed inward from the surfaces of the first condensate water panel 20 and the second condensate water panel 30.

Figure 7:
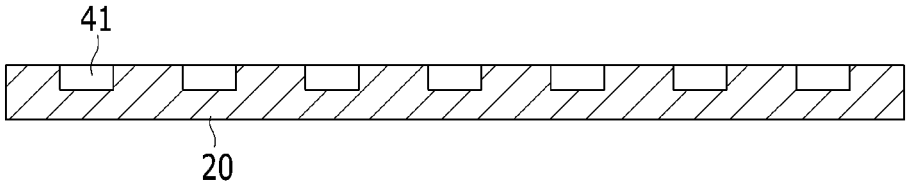
FIG. 7 is a cross-sectional view of the first condensate water panel taken along line VII-VII FIG. 6.
Figure 8:
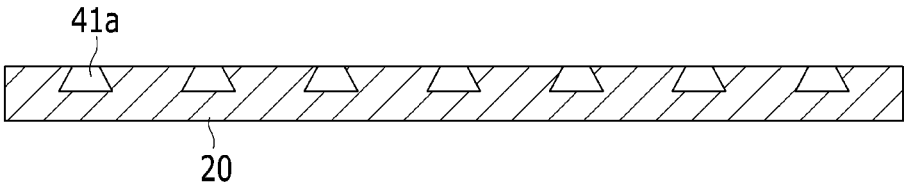
FIG. 8 is a cross-sectional view schematically illustrating a state in which guide slits having a triangular groove shape are formed in the first condensate water panel.

FIG. 7 is a cross-sectional view of the first condensate water panel taken along line VII-VII FIG. 6. As illustrated in FIG. 7, a recessed groove for forming the first slit 41 and the second slit 43 may be formed as a polygonal groove. FIG. 8 is a cross-sectional view schematically illustrating a state in which guide slots having a triangular groove shape are formed in the first condensate water panel.

As illustrated in FIG. 8, a recessed groove for forming the first slit 41*a* may be formed as a triangular groove. Here, like the first slit, the second slit may also be formed as a triangular groove.

Figure 9:
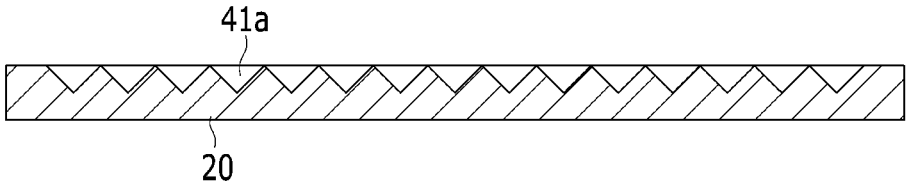
FIG. 9 is a cross-sectional view schematically illustrating a state in which guide slits having a concave-convex shape are formed in the first condensate water panel.

FIG. 9 is a cross-sectional view schematically illustrating a state in which guide slots having a concave-convex shape are formed in the first condensate water panel. As illustrated in FIG. 9, a recessed groove for forming the first slit 41*a* may be formed in a triangular concave-convex shape. Here, like the first slit, the second slit may also be formed as a triangular groove.

As described above, since the first condensate water panel 20 having the superhydrophilic surface and the second condensate water panel 30 having the superhydrophobic surface are attached to the inner wall surface of the dryer main body 10 of the condensate water control dryer 100, the moisture evaporated in the dryer main body 10 is condensed on the first condensate water panel 20, and the condensate water may be smoothly moved to the second condensate water panel 30 by its own weight.

Therefore, the processes in which the condensate water is produced and flows in the dryer main body 10 are carried out without using external energy, and the condensate water may flow by its own weight and drier slots, and as a result, it is possible to improve drying performance by preventing the condensate water from being introduced into the object to be dried.

Figure 10:
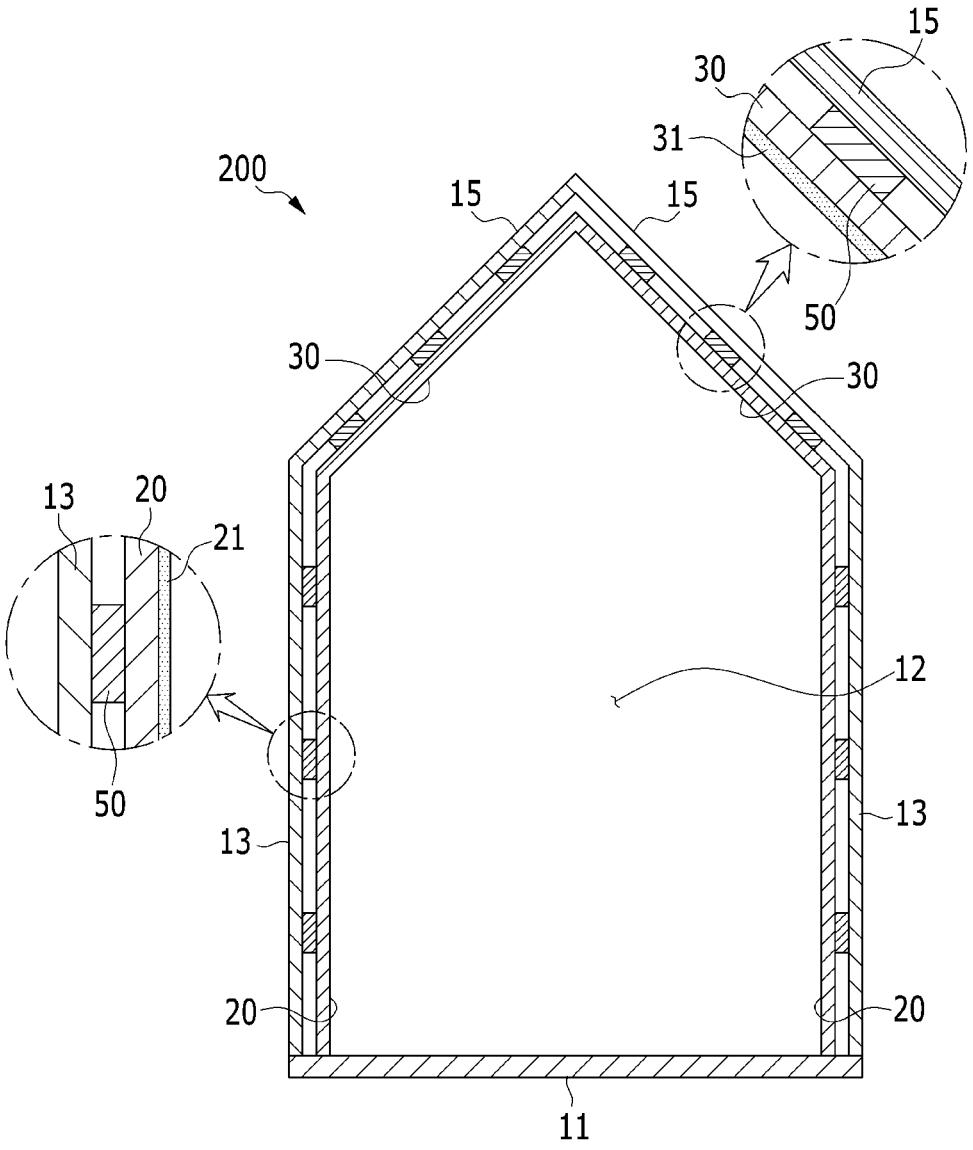
FIG. 10 is a perspective view schematically illustrating a condensate water control dryer according to a second exemplary embodiment of the present invention.

FIG. 10 is a perspective view schematically illustrating a condensate water control dryer according a second exemplary embodiment of the present invention. The same reference numerals in FIGS. 1 to 9 indicate the same constituent elements having the same functions. Detailed descriptions regarding the constituent elements having the same reference numerals will be omitted below.

As illustrated in FIG. 10, in a condensate water control dryer 200 according to the second exemplary embodiment of the present invention, the first condensate water panel 20 having the superhydrophilic surface is attached to the surface of the roof plate 15 by the attachment members 50. Further, the second condensate water panel 30 having the superhydrophobic surface is attached to the surface of the lateral plate 13.

Since the first condensate water panel 20 is installed on the roof plate 15 and the second condensate water panel 30 is installed on the lateral plate 13 as described above, the condensate water, which is produced on the surface of the first condensate water panel 20, may easily flow by its own weight in the direction toward the second condensate water panel 30, such that natural convection of the condensate water may be smoothly carried out, thereby improving drying performance.

The present invention has been described above with reference with the exemplary embodiment illustrated in the drawings. However, the present invention is not limited thereto, and various modified embodiments or other exemplary embodiments, which are equivalent to the present invention, may be made by those skilled in the art to which the present invention pertains.

What is claimed is:

1. A condensate water control dryer comprising:

a dryer main body which has a drying space formed therein;

a first condensate water panel which is attached, in a first direction, to an inner wall surface of the drying space of the dryer main body and has a superhydrophilic surface;

a second condensate water panel which is attached, in a second direction that intersects the first direction, to the inner wall surface of the drying space of the dryer main body and has a superhydrophobic surface; and attachment members which attach the first condensate water panel and the second condensate water panel to the inner wall surface of the dryer main body.

2. The condensate water control dryer of claim 1, wherein:

the dryer main body includes:

a bottom plate which is supported on a floor;

a pair of lateral plates which is assembled to the bottom plate and defines sidewalls;

a roof plate which is assembled to the lateral plate; and a door plate which is rotatably installed on the lateral plate and seals the drying space.

3. The condensate water control dryer of claim 2, wherein:

the first condensate water panel is attached to the lateral plate in the drying space, and the second condensate water panel is attached to the roof plate in the drying space.

4. The condensate water control dryer of claim 2, wherein:

the first condensate water panel is attached to the roof plate in the drying space, and the second condensate water panel is attached to the lateral plate in the drying space.

5. The condensate water control dryer of claim 3, wherein:

guide slots, which guide a flow of the condensate water produced in the drying space, are formed in surfaces of the first condensate water panel and the second condensate water panel.

6. The condensate water control dryer of claim 5, wherein:

the guide slots include:

first slits which are formed in the first condensate water panel; and second slits which are formed in the second condensate water panel in a direction that intersects a direction in which the first slits are formed.

7. The condensate water control dryer of claim 5, wherein:

the guide slots are formed as a plurality of recessed grooves which is recessed inward from the surfaces of the first condensate water panel and the second condensate water panel.

8. The condensate water control dryer of claim 1, wherein:

the dryer main body, the first condensate water panel, and the second condensate water panel are made of an electro-conductive steel material.

9. The condensate water control dryer of claim 8, wherein:

the attachment member is a magnetic member having magnetic force.

10. The condensate water control dryer of claim 4, wherein:

guide slots, which guide a flow of the condensate water produced in the drying space, are formed in surfaces of the first condensate water panel and the second condensate water panel.

11. The condensate water control dryer of claim 10, wherein:

the guide slots include:

first slits which are formed in the first condensate water panel; and second slits which are formed in the second condensate water panel in a direction that intersects a direction in which the first slits are formed.

12. The condensate water control dryer of claim 10, wherein:

the guide slots are formed as a plurality of recessed grooves which is recessed inward from the surfaces of the first condensate water panel and the second condensate water panel.

* * * * *